US007705227B2

(12) United States Patent
Hamanaga

(10) Patent No.: US 7,705,227 B2
(45) Date of Patent: Apr. 27, 2010

(54) MOUTHPIECE OF BRASS INSTRUMENT

(75) Inventor: Shinji Hamanaga, Hamamatsu (JP)

(73) Assignee: Best Brass Corporation, Hamamatsu-shi (JP)

( * ) Notice: Subject to any disclaimer, the term of this patent is extended or adjusted under 35 U.S.C. 154(b) by 0 days.

(21) Appl. No.: 12/322,020

(22) Filed: Jan. 28, 2009

(65) Prior Publication Data

US 2010/0011937 A1 Jan. 21, 2010

(30) Foreign Application Priority Data

Jul. 17, 2008 (JP) ..... 2008-185462

(51) Int. Cl.
*G10D 7/10* (2006.01)

(52) U.S. Cl. ..... 84/387 R

(58) Field of Classification Search ..... 84/387, 84/398, 399, 387 R, 387 A
See application file for complete search history.

(56) References Cited

U.S. PATENT DOCUMENTS 862,819 A * 8/1907 Harrison ..... 84/398

4,395,933 A * 8/1983 Shepley ..... 84/399

* cited by examiner

*Primary Examiner*—Kimberly R Lockett
(74) *Attorney, Agent, or Firm*—Flynn, Thiel, Boutell & Tanis, P.C.

(57) ABSTRACT

A mouthpiece of a brass instrument is provided. The mouthpiece of the brass instrument can cause lips to vibrate efficiently while having a throat of the size allowing to produce a loud sound so that the brass instrument is made easier to blow, durability is improved, and excellent sound quality can be generated with improved sound production in high tone and low tone areas.

A user of the mouthpiece may feel blowing resistance because a breath more than necessary has been blown to obtain moderate blowing resistance for the user. However, by using helpful blowing resistance (reflected pressure) causing lips to vibrate easily by a resistance part formed at least in a portion of an inner wall area of the throat, lips are allowed to vibrate efficiently, the user can perform easily, and the user is made less fatigued. Also, high tones can now be played, stable low tones are obtained, and the sound itself becomes deep and impressive.

11 Claims, 8 Drawing Sheets

MOUTHPIECE OF BRASS INSTRUMENT

BACKGROUND OF THE INVENTION

1. Field of the Invention

The present invention relates to a mouthpiece of a brass instrument held to one's mouth when a trumpet, trombone, or the like is used.

2. Description of the Related Art

There are various types of brass instruments and, for example, a trumpet is one typical instrument thereof. In a general trumpet, lips vibrate due to a breath blown by a player to generate a sound wave. The sound wave repeatedly travels back and forth in the instrument at the speed of sound and a portion thereof is discharged from the bell.

Incidentally, the mouthpiece is an important part through which air is blown while the mouthpiece being held to one's mouth and includes, as described in Japanese Patent Application Laid-Open Nos. 5-127665, 10-214080, and 2004-61573, each part of a rim, cup, shoulder, throat, back-bore, and shank.

According to Japanese Patent Application Laid-Open No. 5-127665, for example, a mouthpiece is formed from a material of titanium or a titanium alloy, or zirconium or a zirconium alloy as a mouthpiece that is lightweight and will not rust and also provides a tone that is different from conventional one.

According to Japanese Patent Application Laid-Open No. 10-214080, an upper half of a rim is formed to be positioned at a location apart from a player by a predetermined distance with respect to a lower half of the rim so that even a player having occlusion in such a way that lower front teeth are positioned toward the player from upper front teeth when viewed from the player can play in a horizontal form.

According to Japanese Patent Application Laid-Open No. 2004-61573, a satin surface constituted by fine innumerable irregularities is formed on an outer circumferential surface of rim where lips come into contact, the front, and an inner surface of a cup so that a mouthpiece becomes soft on lips, a slip can be prevented to prevent an error caused by a slip during performance, and also fatigue caused by performance can be mitigated.

Various techniques of the mouthpiece of a brass instrument held to one's mouth have been proposed, as described above, but the cup, shoulder, throat, and backbore directly relate to a sense of resistance and a problem of a conventional mouthpiece to be solved is that when lips are fatigued, lips may not vibrate so that no sound is produced.

Particularly, it is generally known that the best place to obtain a moderate sense of resistance is only the throat, places where sound pressure is maximal for all sounds are only the cup and throat, and blowing resistance decreases with an increasing throat diameter and conversely increases with a decreasing throat diameter so that a moderate sense of resistance helps the player, but no technique concerning the throat has been disclosed.

The Bernoulli's theorem of "If the flow rate goes up, pressure drops" is known and applying this theorem to a phenomenon that occurs in a throat part of a mouthpiece yields "If the flow rate goes up by making the throat smaller, sound pressure drops". From the standpoint of a player, this means that if the throat is made smaller, lips vibrate more easily with increasing blowing resistance, but a loud sound cannot be produced.

The throat has been completely round with a smooth surface and only the throat diameter is changed, for example, in accordance with the brass instrument.

The present invention has been made in view of the above circumstances and an object thereof is to provide a mouthpiece capable of causing lips to vibrate efficiently while having a throat of the size allowing to produce a loud sound so that a brass instrument is made easier to blow, durability is improved, and excellent sound quality can be generated with improved sound production in high tone and low tone areas.

SUMMARY OF THE INVENTION

The present invention is constituted as described below to solve the above problem and achieve the object.

A mouthpiece of a brass instrument having a cup, a throat stretching from a bottom of the cup via a shoulder, and a backbore stretching to the throat in accordance with a first aspect of the present invention includes:

forming a resistance part to increase blowing resistance at least on a portion of an inner wall area of the throat.

In accordance with a second aspect of the present invention, grooves or irregularities constitute the resistance part.

In accordance with a third aspect of the present invention, the mouthpiece of a brass instrument in accordance with the first aspect includes: making surface roughness on an inner wall surface of the throat rougher than that on the inner wall surface of the cup.

With the above constitution, the present invention achieves effects shown below.

A player who blows a mouthpiece in accordance with the first aspect for the first time feels blowing resistance stronger than before. A reason for this feeling is that a breath more than necessary has been blown to obtain moderate blowing resistance for the player, that is, reflected pressure (pressure inside a cup) to help natural vibration of lips from the mouthpiece that has been in use. With such inefficient blowing, durability of the mouthpiece is reduced and the range of tones cannot be expanded.

Therefore, in accordance with the first aspect, if helpful blowing resistance (reflected pressure) causing lips to vibrate easily by the resistance part to increase blowing resistance (pressure inside the cup) formed at least on a portion of an inner wall area of a throat is used, lips vibrate efficiently, brass instruments can be played easily, the player becomes less fatigued, and resulting from these factors, high tones that could not be played can now be played, stable low tones are obtained, and the sound itself becomes deep and impressive.

In accordance with the third aspect of the present invention, by making surface roughness on the inner wall surface of the throat rougher than that on the inner wall surface of the cup, lips vibrate efficiently, brass instruments can be played easily, the player becomes less fatigued, and resulting from these factors, high tones that could not be played can now be played, stable low tones are obtained, and the sound itself becomes deep and impressive.

DETAILED DESCRIPTION OF THE PREFERRED EMBODIMENTS

Embodiments of the mouthpiece of a brass instrument of the present invention will be described below. Embodiments of the present invention show the most preferred embodiments of the invention and the present invention is not limited to these embodiments.

First Embodiment (Constitution of the Mouthpiece)

Figure 1:
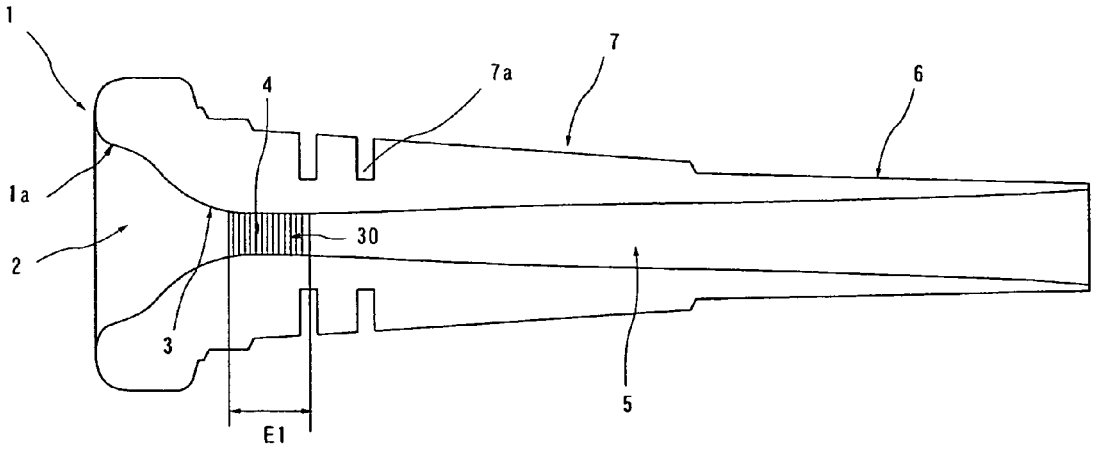
FIG. 1 is a sectional view of a mouthpiece of a trumpet.

FIG. 1 is an embodiment showing a sectional view of a mouthpiece of a trumpet. Reference numeral 1 in FIG. 1 shows a rim, reference numeral la a rim bite, reference numeral 2 a cup, reference numeral 3 a shoulder, reference numeral 4 a throat, reference numeral 5 a backbore, reference numeral 6 a shank, and reference numeral 7 an outer diameter part. The rim 1 and the cup 2 are parts with which lips come directly into contact when the trumpet is blown and air is blown from the cup 2, the shoulder 3, the throat 4, and the backbore 5 into the trumpet. Thus, a brass instrument such as a trumpet has the cup 2 stretching from the rim bite la in an inner edge of the rim 1, the throat 4 stretching from the bottom of the cup 2 via the shoulder 3, and the backbore 5 stretching to the throat 4 and produces a sound when lips vibrate. A sound wave generated by being blown or absorbed travels back and forth inside the instrument at the speed of sound to efficiently vibrate lips.

The mouthpiece is formed from a material such as brass, silver, stainless, and titanium and has, for example, a pure gold-plating finish after molding by forging, machining, and reaming and a thick pure silver-plating layer as a substrate so that a touch of the smooth rim 1 is added and the possibility of plating lifting and the like is reduced. Gold plating makes lip control easier than silver-plating and also makes the sound richer. The constitution of the rim 1, the cup 2, the shoulder 3, the throat 4, the backbore 5, the shank 6, and the outer diameter part 7 of the mouthpiece will be described below.

The rim 1 is an important part with which lips of a player come directly into contact. The surface of lips is moistened by the tongue, the rim 1 is slid down from the upper lip to set the rim 1 at a desired position, and whether or not the position is comfortable with the size of rim inner diameter, rim contour, rim width, and rim bite is determined.

The cup 2 has various cup depths and various kinds of cup shapes such as U-cup, V-cup, and double-cup are present. The cup depth and cup shape can affect tones and musical intervals.

The shoulder 3 can also change blowing resistance by the shape thereof, for example, if the shoulder has a square shape, blowing resistance increases to produce a clear and stiff sound and, conversely, if the shoulder has a gentle shape, blowing resistance decreases to produce a dark and soft sound.

The throat 4 is a place where the player and the instrument are balanced and particularly affects blowing resistance. That is, the throat 4 is a place where a moderate sense of resistance is obtained, sound pressure is maximal for all sounds only in the cup 2 and the throat 4, and blowing resistance decreases with an increasing throat diameter and conversely increases with a decreasing throat diameter so that a moderate sense of resistance helps the player blow.

The backbore 5 affects the musical interval of low tones by thickness of the whole backbore and can control the musical interval balance of high tones by providing a complex inner diameter shape based on sound pressure distribution. Generally, a thin backbore is compatible with a shallow cup and a thick backbore is compatible with a deep cup.

The shank 6 has a slightly tapered shape on a tip side and the mouthpiece is detachably attached to a mouthpiece receiver of a trumpet by the shank 6.

The outer diameter part 7 has various shapes and the sound is affected, in addition to design preference, whether the mouthpiece is heavy or light. Generally, a heavy mouthpiece excels in long-range nature and a light mouthpiece excels in flexibility. Also, feelings when an instrument is played also changes depending on whether which part of the mouthpiece is thick (heavy) and which part is thin (light) and the long-range nature and flexibility are made compatible by forming acoustic slits 7*a*.

(Example in Which Grooves are Formed in the Inner Wall Area of a Throat)

In the present embodiment, grooves 30 are formed in an inner wall area E1 of the throat 4 as a resistance part to increase blowing resistance (pressure inside the cup). While the grooves 30 are formed in the whole inner wall area E1 in the present embodiment, the grooves 30 may be formed in a portion of the inner wall area E1 so that the grooves 30 are formed at least in a portion of the inner wall area E1. The grooves 30 are formed simply by cutting the inner surface of the throat 4, but the method is not limited to this and the grooves 30 may be formed, for example, by tapping or casting of a mouthpiece.

Figure 2:
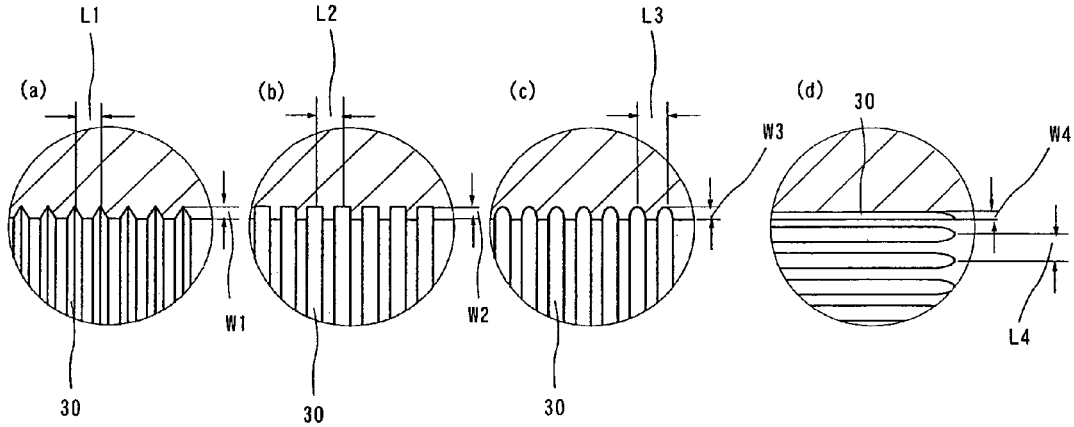
FIG. 2 is an enlarged view of an example in which grooves are formed in an inner wall area of a throat.

The sectional shape, intervals, and orientation of the grooves 30 are not specifically limited and Examples 1 to 4 are shown in enlarged sectional views in FIG. 2. FIG. 2(*a*) shows the grooves 30 that have a triangular sectional view and a depth W1 and are formed at a predetermined interval L1 in a circumferential direction of the throat to form a plurality of annular grooves. FIG. 2(*b*) shows the grooves 30 that have a quadrangular sectional view and a depth W2 and are formed at a predetermined interval L2 in the circumferential direction of the throat to form a plurality of annular grooves. FIG. 2(*c*) shows the grooves 30 that have a semicircular sectional view and a depth W3 and are formed at a predetermined interval L3 in the circumferential direction of the throat to form a plurality of annular grooves. FIG. 2(*d*) shows the grooves 30 that have a semicircular sectional view and a depth W4 and are formed at the predetermined interval L3 in an axial direction of the throat to form a plurality of linear grooves.

The depths W1 to W4 and the predetermined intervals L1 to L3 of the grooves 30 of Examples in FIGS. 2(*a*) to 2(*d*) can freely be set in accordance with a trumpet or the like. While the grooves 30 of Examples in FIGS. 2(*a*) to 2(*c*) are annular grooves, the grooves 30 may be helical grooves. Further, while the grooves 30 of Example in FIG. 2(*d*) are parallel to the axial direction of the throat, the grooves 30 may be formed by tilting by a predetermined angle with respect to the axial direction of the throat.

(Example in which Irregularities are Formed in the Inner Wall Area of a Throat)

In the present embodiment, irregularities 40 are formed in the inner wall area E1 of the throat 4 as a resistance part to increase blowing resistance. While the irregularities 40 are formed in the whole inner wall area E1 also in the present embodiment, the irregularities 40 may be formed in a portion of the inner wall area E1 so that the irregularities 40 are formed at least in a portion of the inner wall area E1. The irregularities 40 are formed simply by cutting the inner surface of the throat 4, but the method is not limited to this and the irregularities 40 may be formed, for example, by casting of a mouthpiece.

Figure 3:
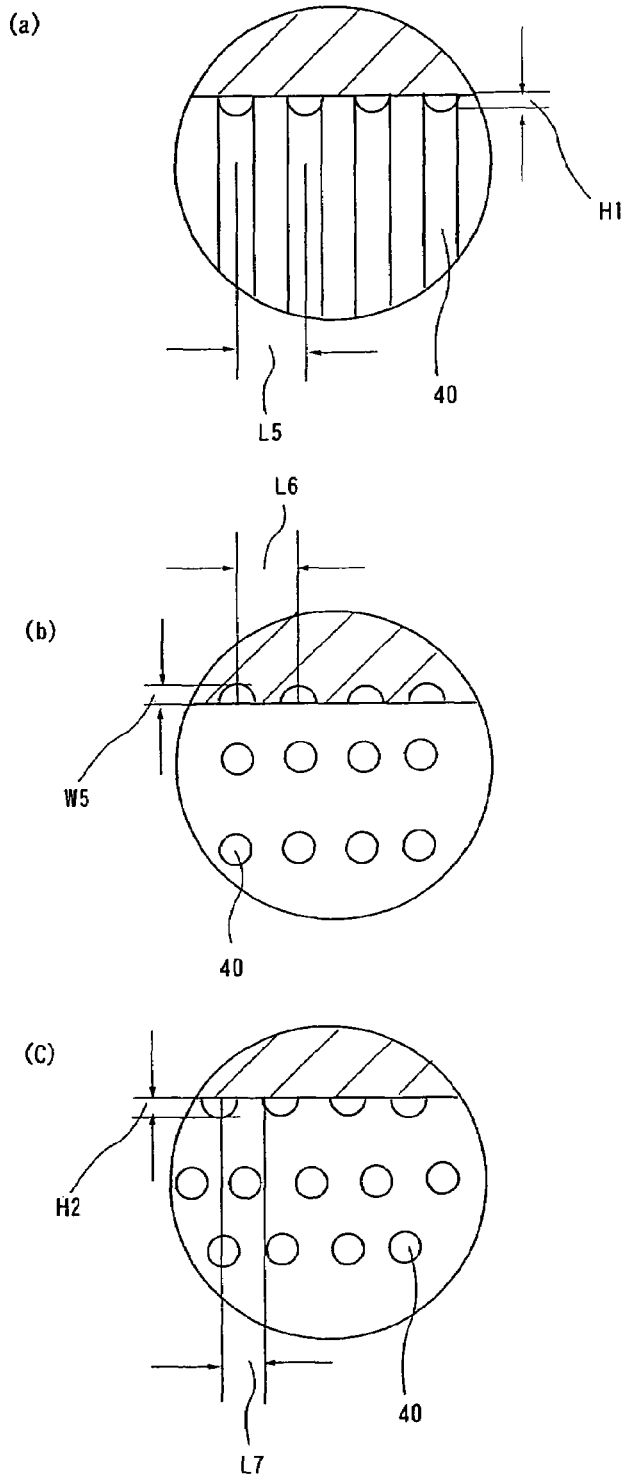
FIG. 3 is an enlarged view of an example in which irregularities are formed in the inner wall area of the throat.

The sectional shape, intervals, and orientation of the irregularities 40 are not specifically limited and Examples 5 to 7 are shown in enlarged sectional views in FIG. 3. FIG. 3(*a*) shows the irregularities 40 that have a semicircular sectional view and a height H1 and are formed at a predetermined interval L5 in the circumferential direction of the throat to form a plurality of annular ribs. FIG. 3(*b*) shows the irregularities 40 that have a semicircular hole sectional view and the depth W5 and are formed at a predetermined interval L6 in the circumferential direction of the throat to arrange a plurality of the irregularities 40 in grid-like fashion. FIG. 3(*c*) shows the irregularities 40 that have a semicircular projection sectional view and the height H2 and are formed at a predetermined interval L7 in the circumferential direction of the throat to arrange a plurality of the irregularities 40 in staggered fashion.

The heights H1 and H2 of the irregularities 40 of Examples in FIGS. 3(*a*) and 3(*c*), the depth W5 of the irregularities 40 of Example in FIG. 3(*b*), and the predetermined intervals L5 to L7 of the irregularities 40 of Examples in FIGS. 3(*a*) to 3(*c*) can freely be set in accordance with a trumpet or the like. While the irregularities 40 of Examples in FIGS. 3(*a*) to 3(*c*) are semicircular, the irregularities 40 may be triangular or quadrangular.

(Utilization of a Mouthpiece)

Figure 4:
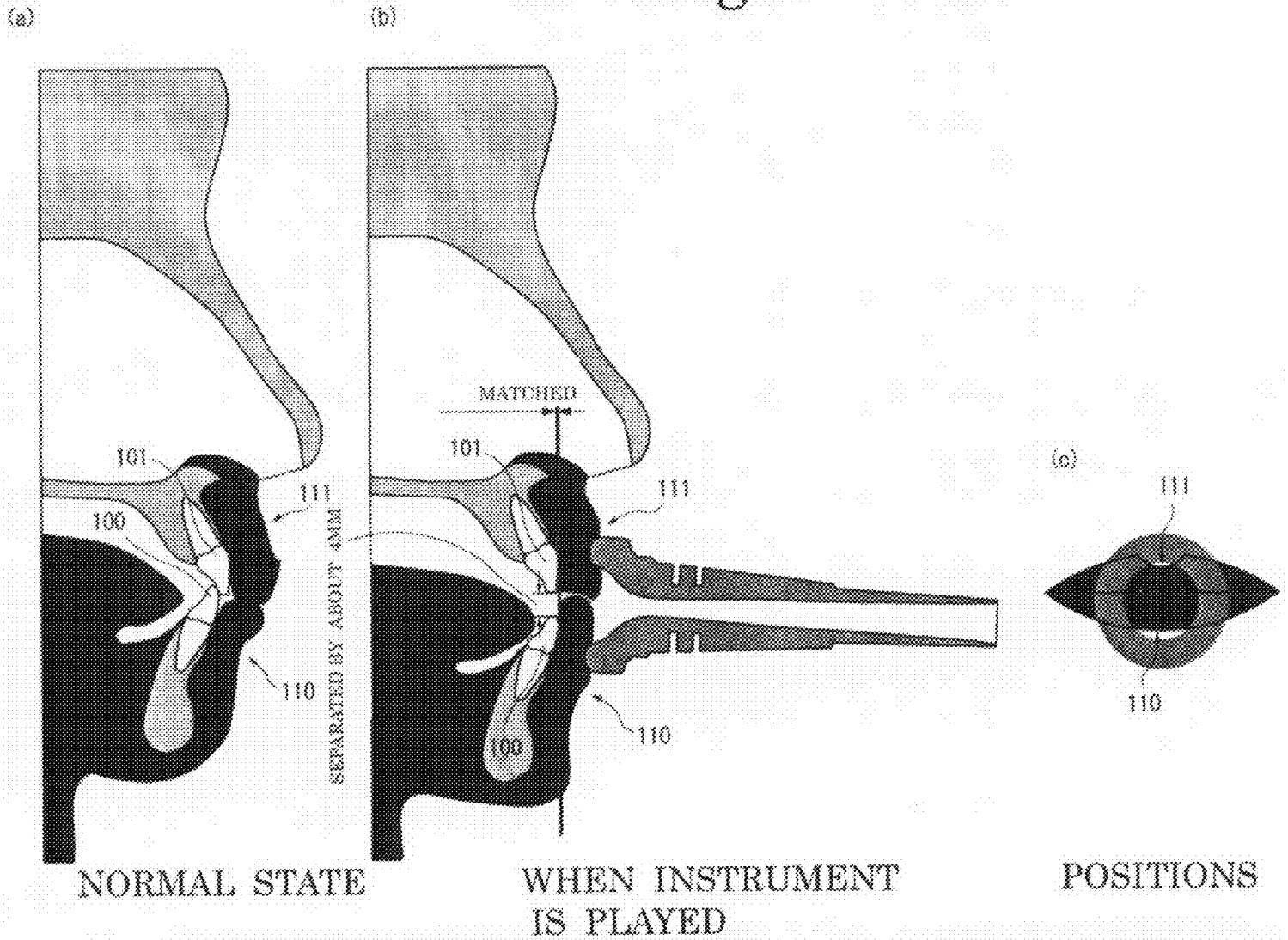
FIG. 4 is a diagram illustrating conditions of use of the mouthpiece.

Utilization of a mouthpiece will be described based on FIG. 4. FIG. 4(*a*) shows a state of lips in a normal state, FIG. 4(*b*) shows a state of lips and a mouthpiece when an instrument is played, and FIG. 4(*c*) shows positions of the lips and the mouthpiece when an instrument is played.

Upper teeth 101 are located forward of lower teeth 100 when the mouth is closed in a normal state, thereby an upper lip 111 being located forward of a lower lip 110. However, the lower teeth 100 and the upper teeth 101 are matched and separated by about 4 mm when an instrument is played and in this state, the lower lip 110 and the upper lip 111 are applied to the rim 1 of the mouthpiece. The lower lip 110 and the upper lip 111 are applied in such a manner that a boundary therebetween is positioned in the central part of the rim 1 to play an instrument.

A player who blows the mouthpiece for the first time feels blowing resistance stronger than before. A reason for this feeling is that a breath more than necessary has been blown to obtain moderate blowing resistance for the player, that is, reflected pressure (pressure inside a cup) to help natural vibration of lips from the mouthpiece that has been in use. With such inefficient blowing, durability of the mouthpiece is reduced and the range of tones cannot be expanded, but in the present embodiment, helpful blowing resistance (reflected pressure) causing lips to vibrate easily is generated by the grooves 30 or the irregularities 40 formed at least in a portion of the inner wall area E of the throat 4. Using the blowing resistance (reflected pressure) allows the lips 110 and 111 to vibrate efficiently, enables a player to perform easily, and makes the player less fatigued. Moreover, resulting from these factors, high tones that could not be played can now be played, stable low tones are obtained, and the sound itself becomes deep and impressive.

Helpful blowing resistance (reflected pressure) causing lips to vibrate easily is generated by the grooves 30 shown in FIGS. 2(*a*) to 2(*c*) and using the blowing resistance (reflected pressure) allows the lips 110 and 111 to vibrate efficiently. Helpful blowing resistance (reflected pressure) is also generated so as to vibrate efficiently is generated by the grooves 30 shown in FIG. 2(*d*) and using the blowing resistance (reflected pressure) allows the lips 110 and 111 to vibrate efficiently. Thus, blowing resistance (reflected pressure) is different depending on the grooves 30 shown in FIGS. 2(*a*) to 2(*d*) so that reflected pressure in accordance with preferences of the player can be obtained.

Also, helpful blowing resistance (reflected pressure) is generated by the irregularities 40 shown in FIGS. 3(*a*) to 3(*c*) and using the blowing resistance (reflected pressure) allows the lips 110 and 111 to vibrate efficiently. Blowing resistance (reflected pressure) is also different depending on the irregularities 40 shown in FIGS. 3(*a*) to 3(*c*) so that reflected pressure in accordance with preferences of the player can be obtained.

Second Embodiment (Constitution of the Mouthpiece)

Figure 5:
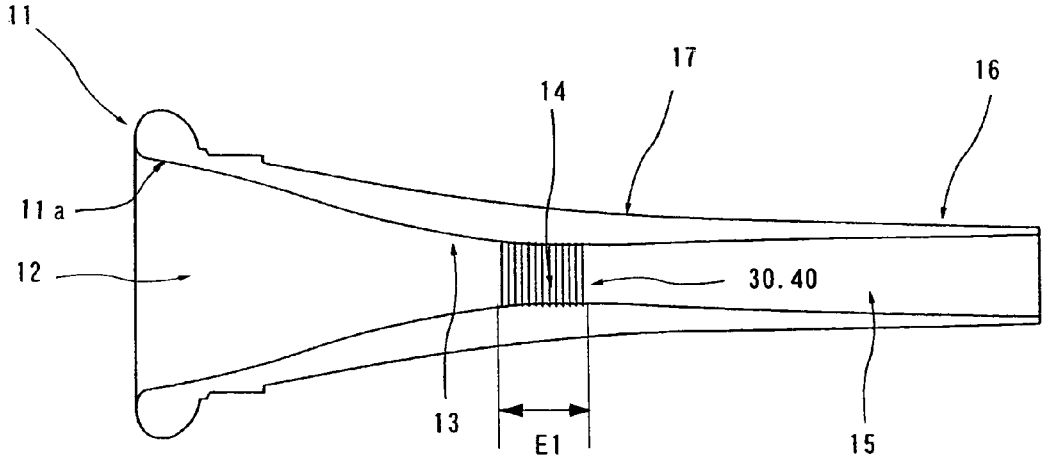
FIG. 5 is a sectional view of the mouthpiece of a horn.

FIG. 5 is an embodiment showing the sectional view of the mouthpiece of a horn. FIG. 5 is an embodiment showing the sectional view of the mouthpiece of a horn. Reference numeral 11 in FIG. 5 shows a rim, reference numeral 11*a* a rim bite, reference numeral 12 a cup, reference numeral 13 a shoulder, reference numeral 14 a throat, reference numeral 15 a backbore, reference numeral 16 a shank, and reference numeral 17 an outer diameter part. The rim 11 and the cup 12 are parts with which lips come directly into contact when the horn is blown and air is blown from the cup 12, the shoulder 13, the throat 14, and the backbore 15 into the horn. The mouthpiece is detachably attached to a mouth-pipe receiver part of the horn and the shank 16 is fitted into the receiver part.

The rim 11, the rim bite 11*a*, the cup 12, the shoulder 13, the throat 14, the backbore 15, the shank 16, and the outer diameter part 17 of the mouthpiece are constituted in the same manner as the rim 1, the cup 2, the shoulder 3, the throat 4, the backbore 5, the shank 6, and the outer diameter part 7 in the first embodiment and thus, a description thereof is omitted.

Like the first embodiment, the grooves 30 or the irregularities 40 are formed in the inner wall area E1 of the throat 14 and thus, the same reference numerals are attached and a description thereof is omitted.

(Utilization of a Mouthpiece)

Figure 6:
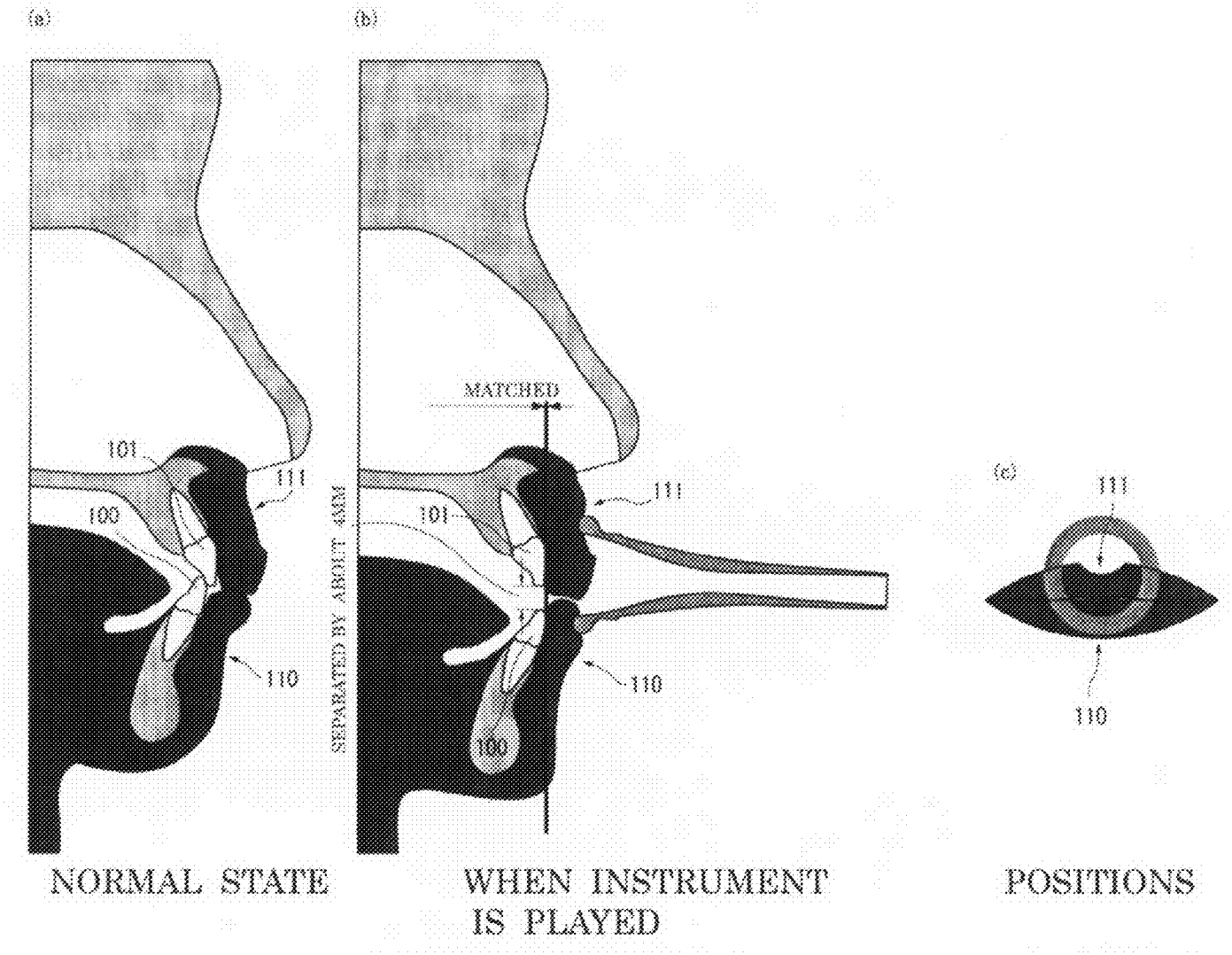
FIG. 6 is a diagram illustrating conditions of use of the mouthpiece.

Utilization of a mouthpiece will be described based on FIG. 6. FIG. 6(*a*) shows a state of lips in a normal state, FIG. 6(*b*) shows a state of lips and a mouthpiece when an instrument is played, and FIG. 6(*c*) shows positions of the lips and the mouthpiece when an instrument is played.

The upper teeth 101 are located forward of the lower teeth 100 when the mouth is closed in a normal state, thereby the upper lip 111 being located forward of the lower lip 110. However, the lower teeth 100 and the upper teeth 101 are matched and separated by about 4 mm when an instrument is played and in this state, the lower lip 110 and the upper lip 111 are applied to the rim 11 of the mouthpiece. The lower lip 110 and the upper lip 111 are applied in such a manner that a boundary therebetween is positioned in the lower part of the rim 11 to play an instrument.

Also in the present embodiment, helpful blowing resistance (reflected pressure) causing lips to vibrate easily is generated by the grooves 30 or the irregularities 40 formed at least in a portion of the inner wall area E of the throat 14. Using the blowing resistance (reflected pressure) allows the lips 110 and 111 to vibrate efficiently, enables a player to perform easily, and makes the player less fatigued. Moreover, resulting from these factors, high tones that could not be played can now be played, stable low tones are obtained, and the sound itself becomes deep and impressive.

Third Embodiment (Constitution of the Mouthpiece)

Figure 7:
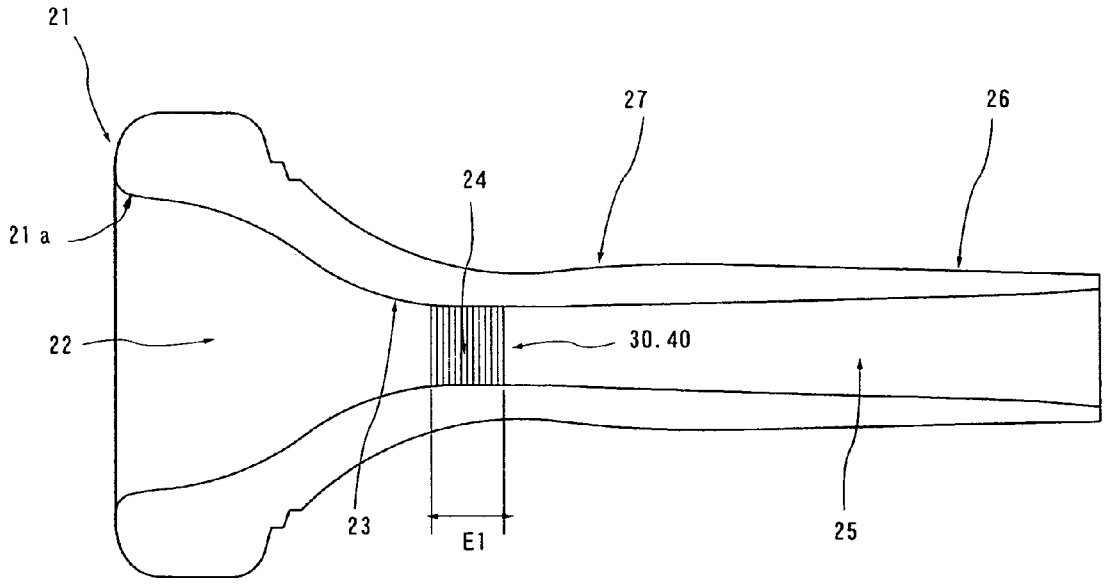
FIG. 7 is a sectional view of the mouthpiece of a trombone.

FIG. 7 is an embodiment showing the sectional view of the mouthpiece of a trombone. Reference numeral 21 in FIG. 7 shows a rim, reference numeral 21*a* a rim bite, reference numeral 22 a cup, reference numeral 23 a shoulder, reference numeral 24 a throat, reference numeral 25 a backbore, and reference numeral 26 a shank. The rim 21 and the cup 22 are parts with which lips come directly into contact when the trombone is blown and air is blown from the cup 22, the shoulder 23, the throat 24, and the backbore 25 into the trombone. The mouthpiece is detachably attached to a mouthpiece receiver of the trombone and the shank 26 is fitted into the mouthpiece receiver.

The rim 21, the rim bite 21*a*, the cup 22, the shoulder 23, the throat 24, the backbore 25, the shank 26, and an outer diameter part 27 of the mouthpiece are constituted in the same manner as the rim 1, the rim bite 21*a*, the cup 2, the shoulder 3, the throat 4, the backbore 5, the shank 6, and the outer diameter part 7 in the first embodiment and thus, a description thereof is omitted.

Like the first embodiment, the grooves 30 or the irregularities 40 are formed in the inner wall area E1 of the throat 24 and thus, the same reference numerals are attached and a description thereof is omitted.

(Utilization of a Mouthpiece)

Figure 8:
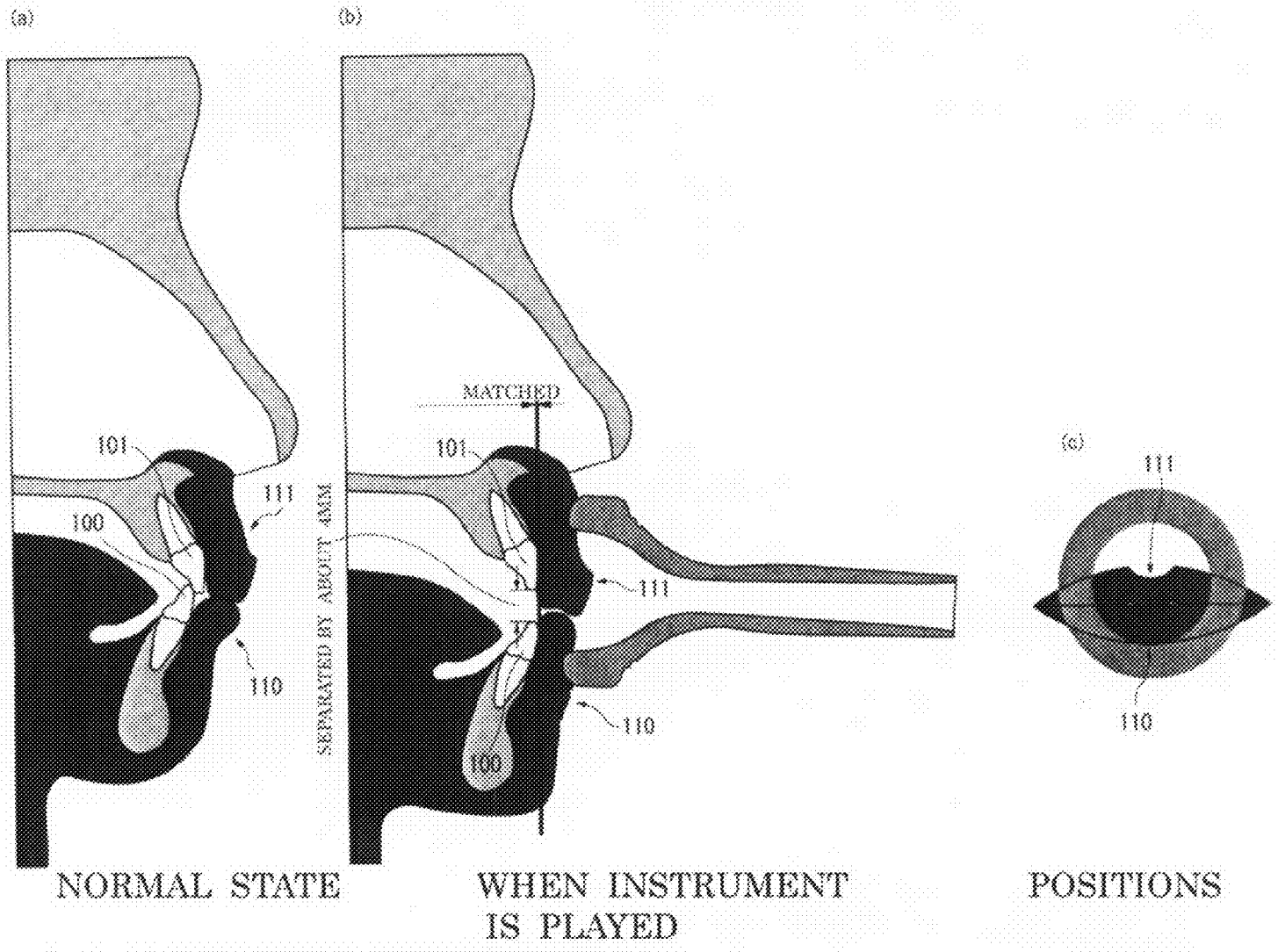
FIG. 8 is a diagram illustrating conditions of use of the trombone.

Utilization of a mouthpiece will be described based on FIG. 8. FIG. 8(*a*) shows a state of lips in a normal state, FIG. 8(*b*) shows a state of lips and a mouthpiece when an instrument is played, and FIG. 8(*c*) shows positions of the lips and the mouthpiece when an instrument is played.

The upper teeth 101 are located forward of the lower teeth 100 when the mouth is closed in a normal state, thereby the upper lip 111 being located forward of the lower lip 110. However, the lower teeth 100 and the upper teeth 101 are matched and separated by about 6 mm when an instrument is played and in this state, the lower lip 110 and the upper lip 111 are applied to the rim 21 of the mouthpiece. The lower lip 110 and the upper lip 111 are applied in such a manner that a boundary therebetween is positioned in the lower part of the rim 21 to play an instrument.

Also in the present embodiment, helpful blowing resistance (reflected pressure) causing lips to vibrate easily is generated by the grooves 30 or the irregularities 40 formed at least in a portion of the inner wall area E of the throat 24. Using the blowing resistance (reflected pressure) allows the lips 110 and 111 to vibrate efficiently, enables a player to perform easily, and makes the player less fatigued. Moreover, resulting from these factors, high tones that could not be played can now be played, stable low tones are obtained, and the sound itself becomes deep and impressive.

In the first embodiment, the resistance part 30 to increase blowing resistance is formed at least in a portion of the inner wall area E1 of the throat 4 and while the resistance part 30 is constituted by grooves or irregularities, surface roughness on the inner wall surface of the throat 4 may be made rougher than that on the inner wall surface of the cup 2. The embodiment in which surface roughness on the inner wall surface of the throat 4 is made rougher than that on the inner wall surface of the cup 2 is not limited to what is described above and, for example, a mouthpiece may be made to have an inner wall surface 4*a* of the throat 4 whose surface roughness is rougher than that of an inner wall surface 2*a* of the cup 2 by molding a material having a through hole by forging, machining the cup 2, reaming the throat 4, reaming the backbore 5 repeatedly, and further, smoothing the inner wall surface 2*a* of the cup 2 and giving plating finish.

By making surface roughness on the inner wall surface of the throat 4 rougher than that on the inner wall surface of the cup 2, a player who blows the mouthpiece for the first time feels blowing resistance stronger than before. A reason for this feeling is that a breath more than necessary has been blown to obtain moderate blowing resistance for the player, that is, reflected pressure (pressure inside a cup) to help natural vibration of lips from the mouthpiece that has been in use. With such inefficient blowing, durability of the mouthpiece is reduced and the range of tones cannot be expanded.

Therefore, if helpful blowing resistance (reflected pressure) causing lips to vibrate easily by increasing blowing resistance (pressure inside a cup) by the throat is used, lips vibrate efficiently, brass instruments can be played easily, the player becomes less fatigued, and resulting from these factors, high tones that could not be played can now be played, stable low tones are obtained, and the sound itself becomes deep and impressive.

Here, target brass instruments include, in addition to the trumpet, horn, trombone, a fluegelhorn, cornet, and tuba.

The present invention is applicable to a mouthpiece of a brass instrument to which the mouth is applied when a trumpet, trombone or the like is used and the mouthpiece can cause lips to vibrate efficiently while having a throat of the size allowing to produce a loud sound so that a brass instrument is made easier to blow, durability is improved, and excellent sound quality can be generated with improved sound production in high tone and low tone areas.

What is claimed is:

1. A mouthpiece of a brass instrument comprising:

a cup;

a shoulder stretching from a lower portion of an inner wall of the cup;

a throat stretching from a bottom of the cup via the shoulder, the throat including grooves forming a resistance part for increasing blowing resistance at least on a portion of an inner wall of the throat by producing a reflected pressure, the grooves having projections and depressions; and a backbore stretching to the throat from a direction opposite to the cup.

2. A mouthpiece of a brass instrument comprising:

a cup;

a shoulder stretching from a lower portion of an inner wall of the cup;

a throat stretching from a bottom of the cup via the shoulder, the throat including irregularities forming a resistance part for increasing blowing resistance at least on a portion of an inner wall of the throat by producing a reflected pressure; and a backbore stretching from the throat to a direction opposite to the cup.

3. The mouthpiece according to claim 1, wherein a surface of the inner wall of the throat is rougher than a surface of the inner wall of the cup.

4. The mouthpiece according to claim 2, wherein a surface of the inner wall of the throat is rougher than a surface of the inner wall of the cup.

5. The mouthpiece according to claim 1, further comprising a rim having a rim bite in an inner edge of the rim from which the cup stretches.

6. The mouthpiece according to claim 2, further comprising a rim having a rim bite in an inner edge of the rim from which the cup stretches.

7. The mouthpiece according to claim 1, further comprising a shank stretching from the backbore, the shank being tapered and allowing the mouthpiece to be detachably attached to a mouthpiece receiver of a trumpet.

8. The mouthpiece according to claim 2, further comprising a shank stretching from the backbore, the shank being tapered and allowing the mouthpiece to be detachably attached to a mouthpiece receiver of a trumpet.

9. The mouthpiece according to claim 1, further comprising acoustic slits on an outer wall of the backbore.

10. The mouthpiece according to claim 2, further comprising acoustic slits on an outer wall of the backbore.

11. A mouthpiece of a brass instrument comprising:

a cup;

a shoulder stretching from a lower portion of an inner wall of the cup;

a throat stretching from a bottom of the cup via the shoulder, the throat including a resistance part for increasing blowing resistance at least on a portion of an inner wall of the throat by producing a reflected pressure; and a backbore stretching to the throat from a direction opposite to the cup.

* * * * *